US005766353A

United States Patent [19]

Madrzak et al.

[11] Patent Number: 5,766,353

[45] Date of Patent: Jun. 16, 1998

[54] APPLICATOR FOR DIRECT OR INDIRECT APPLICATION OF A LIQUID OR PASTY MEDIUM ON A TRAVELING MATERIAL WEB

[75] Inventors: Zygmunt Madrzak, Heidenheim; Manfred Ueberschär, Nattheim, both of Germany

[73] Assignee: Voith Sulzer Papiermaschinen GmbH, Heidenheim, Germany

[21] Appl. No.: 854,401

[22] Filed: May 12, 1997

[30] Foreign Application Priority Data

May 13, 1996 [DE] Germany ..... 196 19 249.8

[51] Int. Cl.[6] ..... B05C 11/02

[52] U.S. Cl. ..... 118/126; 118/117; 118/119

[58] Field of Search ..... 118/123, 122, 118/126, 261, 118, 119, 413, 419, 117; 162/281; 15/256.51; 101/425

[56] References Cited

FOREIGN PATENT DOCUMENTS 23 32 448 2/1978 Germany .

3313972 A1 10/1984 Germany .

*Primary Examiner*—Brenda A. Lamb

*Attorney, Agent, or Firm*—Taylor & Associates, P.C.

[57] ABSTRACT

An applicator for direct or indirect application of a liquid or pasty medium on a traveling material web includes a support beam, a mating roll opposing the support beam, and a doctor element extending across the width of the mating roll and detachably fixed on the support beam via a holder. The holder includes an actuator and a pressure apparatus operable and brought in contact (K) with the doctor element by the actuator, for pressing the doctor element on an abutment surface. The lever type pressure apparatus is disposed in a region between the mating roll and the support beam, and includes at least one elastic spring element acting directly or indirectly on the lever type pressure apparatus, against the reset force of which spring element acts the actuator upon its activation, and which spring element, upon deactivation of the actuator, lifts by its reset force the contact (K) between the pressure apparatus and the doctor element, releasing the contact (K).

20 Claims, 4 Drawing Sheets

APPLICATOR FOR DIRECT OR INDIRECT APPLICATION OF A LIQUID OR PASTY MEDIUM ON A TRAVELING MATERIAL WEB

BACKGROUND OF THE INVENTION

1. Field of the Invention

The present invention relates to an applicator for direct or indirect application of a liquid or pasty medium on a traveling fiber material web, notably of paper or cardboard.

2. Description of the Related Art

An applicator as described above is known from DE 3 220 075 C2, which discloses a support beam with a longitudinal direction extending substantially across the entire width of the material web. A mating roll opposes the support beam, and a doctor element extends substantially across the entire width of the mating roll. The doctor element has the shape of a doctor blade which by use of a holder is detachably fixed on the support beam. The holder features an actuator and, operable by the actuator, a lever-type pressure apparatus adapted for making contact with the doctor blade and serving to press the doctor blade on a mating support. Viewing the applicator sideways, the lever type pressure apparatus is disposed in the region between the mating roll and the support beam. Moreover, the applicator comprises a pressure element which is arranged on the support beam, and can be acted upon directly or indirectly by a pressure apparatus with a contact pressure, with which pressure element the doctor blade can be pressed on the mating roll in the area of its end associated with the mating roll. The specialty of this known applicator is that the pressure chamber of the applicator, containing the liquid or pasty medium, is designed as the lever type pressure apparatus which fixes, or clamps, the doctor blade in place. The doctor blade itself rests with its narrow side edge, away from the mating roll, in a continuous groove extending across the entire length of the support beam, or on a corresponding projection of the support beam, and is pressed, by the pressure apparatus explained above, on the abutment formed by a side surface of the support beam, and is thus fastened.

Due to the illustrated movable design of the pressure chamber, however, this applicator is rather involved in manufacture and maintenance and, thus, also costly. The region or space between the mating roll and support beam of an applicator, specifically on account of the roll geometry and of the doctor blade, which in operation must be brought in contact with the mating roll is limited. With the described pressure chamber of lever type design, due to its configuration and required coating angle, assuming a space-intensive arrangement and, consequently, needing to be positioned at a certain distance from the mating roll, the solution proposed in the framework of DE 3 220 075 C2 provides overall a more voluminous applicator which fails to optimally utilize the given space conditions. Furthermore, it has been demonstrated that the mounting of the doctor blade on a continuous groove extending across the entire length of the support beam or on a corresponding projection of the support beam may lead to manufacturing difficulties and a quality impairment of the coating to be applied on the mating roll or on a material web carried on the mating roll. Both in the operation of the applicator and in the replacement of a doctor blade, namely, remnants of the liquid or pasty medium stick to the area of the doctor blade support points or, with the blade removed, run into the groove or on the projection and the lateral abutment of the doctor blade. Resulting from these remnants of the liquid or pasty medium, specifically when these adhere already or have hardened, are inaccuracies of fit of the facing and support faces and, thus, an incorrect seating of the newly fixed doctor blade, leading in turn to considerable irregularities in the length profile and cross profile of the applied medium that are difficult to compensate for by control mechanisms. Also, the remnants impede the cleaning of the applicator and are the cause of extended machine downtime. Lastly, it has in conjunction with such applicator also been shown that the repeated loosening of the doctor blade from the clamping of the holder and the opening of the holder associated with it, necessary for purposes of maintenance or doctor blade replacement, is either difficult or has so far been carried out only with the aid of expensive and disadvantageous actuator constructions. Namely, opening the holder often continues to be done manually, requiring a plurality of manipulations. This leads to extended machine downtime and increased maintenance costs. Actuators known so far, which allow also to open the doctor blade holder, must for this purpose also provide a force for opening the holder, in addition to the closing force for fixing the doctor blade in the holder. Resulting thereof, however, are rather involved, complex, uneconomical and thus expensive constructions.

Known, furthermore, from WO 93/05887 is an applicator comparable with the embodiment relative to DE 3 220 075 C2, but where the lever type pressure apparatus that fixes the doctor blade in clamping fashion is arranged on the side of a lip-like holder away from the mating roll.

What is needed in the art is a simple and effective applicator which extensively avoids the disadvantages associated with the known designs.

SUMMARY OF THE INVENTION

The applicator of the present invention for direct or indirect application of a liquid or pasty medium on a traveling material web, notably of paper or cardboard, includes a support beam extending in its longitudinal direction substantially across the entire width of the material web, a mating roll opposing the support beam, and a doctor element extending substantially across the entire width of the mating roll and fixed detachably on the support beam by way of a holder. The holder features an actuator and a lever type pressure apparatus operated and brought in contact with the doctor element by the actuator while serving to press the doctor blade on an abutment. The lever type pressure apparatus—with the applicator viewed sideways—disposed in a region between the mating roll and the support beam, includes a pressure element mounted on the support beam and acted upon directly or indirectly by a pressure apparatus with a pressure force, by which pressure element the doctor element can be forced, in the region of its end associated with the mating roll, on the mating roll. At least one elastic spring element acts directly or indirectly on the lever type pressure apparatus, against the reset force of which spring element the actuator acts when activated. The spring element releases the pressure apparatus upon actuator deactivation by its reset force from contact with the doctor element, releasing the latter. Meant by elastic spring element in the sense of the invention is basically any spring element suited for the intended purpose, for example, also tension springs, compression springs, spiral springs, leaf springs, torsion springs, pneumatic spring systems, saucer springs of metal or other materials, as well as specifically rubber springs, respectively springs of thermoplastics, duroplastics and elastomers and the like. The spring element may or may not be prestressed in its neutral position in which it does not develop a reset force.

The inventional applicator allows an especially easy handling in replacing the doctor element, since the reset force of the elastic spring element opens the pressure apparatus upon deactivation of the actuator automatically and releases the doctor element. Expensive and time-intensive manual steps for opening the pressure apparatus and releasing the doctor element are therefore not required. The opening function of the pressure apparatus being in the present invention separated from the actuator of the pressure apparatus, unlike in the prior art, the actuator as such allows considerable simplification and normally also reduction in size. For example, a one-sidedly acting actuator (i.e., one that exerts only the force for pressing the doctor element down and fixing it), can be used, which consequently is simpler and more low-cost in its engineering. Rendered more multifarious with it are also the mounting options of the actuator at specific suitable positions of the applicator. Furthermore, the elastic spring element assuming the opening function allows a design as a comparably plain component and contributes, besides the aforementioned facilitation in handling, also to a cost reduction in the manufacture of the inventional applicator. As will be illustrated in detail hereafter, the inventional applicator enables also a very favorable arrangement and design of the lever type pressure apparatus contacting the doctor element and a more effective space utilization in the region between the mating roll and the support beam. In turn, this allows the manufacture of a more compact applicator. Lastly, due to the inventional design, also the applicator cleaning can be simplified, as will be illustrated in detail hereafter.

According to a favorable design feature of the invention, the lever type pressure apparatus is a single-arm, lever type pressure apparatus. Such pressure apparatus allows in view of engineering an especially easy realization and a space-saving integration in the inventional applicator.

One embodiment of the invention provides for the lever type pressure apparatus as a double-arm lever type pressure apparatus. This variant allows an especially favorable adaptation of the lever form to the space available for add-ons between the mating roll and support beam and, furthermore, also a favorable and easy arrangement of the actuator that operates the lever type pressure apparatus, relative to the mounting site of the pressure apparatus. Instead of a single-arm or double-arm lever type pressure apparatus, naturally, also a lever type pressure apparatus is basically usable with sequences of motion that are realized via more involved gear mechanisms.

In conjunction with a double-arm lever type pressure apparatus it has proved to be favorable to arrange the actuator in the region of the lever arm of the double-arm lever type pressure apparatus distal in relation to the doctor element. With the space typically available in applicators between mating roll and support beam diminishing toward the point of contact between the doctor element and mating roll, but widening in the opposite direction, in which is disposed also the lever arm distal in relation to the doctor element, the actuator thus allows a very space-saving arrangement in the expanding section of the space, which has a positive effect on the size of the applicator. The space conditions also make it possible to fashion the distal lever arm longer than the proximal arm, thus achieving with simple means favorable mechanical advantages and high pressures.

According to another embodiment of the invention, the lever arm associated with the actuator, i.e., the distal lever arm, includes in the case of a double-arm lever type pressure apparatus at least one section that is bent and/or angled toward the mating roll. The bent and/or angled section follows suitably with a certain clearance substantially the contour of the mating roll, thus providing space for an actuator disposed between the lever arm and support beam and acting on the distal lever arm. The region situated between the mating roll and support beam can spatially be utilized optimally thereby. The lever geometry of the lever type pressure apparatus and the aforementioned clearances both toward the mating roll and the support beam are selected that the pressure apparatus possesses in its actuation sufficient freedom of movement and, specifically, does not strike the rotating mating roll. The distal lever arm associated with the actuator may suitably possess suitable bearing faces or connecting means for the actuator.

According to a further embodiment of the invention, the elastic spring element is disposed in the immediate region of the axle of the lever type pressure apparatus, between the lever type pressure apparatus and a support face proximal to the support beam. The spring element may here be in direct contact with the lever type pressure apparatus, thus developing a reset force immediately upon actuation of the pressure apparatus, or may be disposed at a certain distance from the pressure apparatus, thus developing a reset force only at an advanced actuation of the pressure apparatus. The exact position of the elastic spring element relative to the lever axle as well as the respective design of the spring element may be selected depending on the reset force of the spring element, the desired mechanical advantage and the lever arm geometry.

It has proved to be advantageous for the elastic spring element to form the lever axle of the lever type pressure apparatus. Thus, the spring element assumes here a double function, namely both the pivotable mounting of the lever type pressure apparatus and the reset effect with the pressure apparatus actuated. With this embodiment it deserves special mention that the reset effect occurs immediately with a pivotal motion of the lever type pressure apparatus. Due to the described double function, a further space saving is accomplished also.

In this context it has been demonstrated to be especially favorable in terms of design to mount the lever type pressure apparatus pivotably on a spacer that extends through the pressure apparatus and the elastic spring element and connects directly or indirectly to the support beam. This spacer, e.g., may be a bolt fastened directly to the support beam and fixing an elastic spring element fashioned as a rubber block or the like, without clearance between the lever type pressure apparatus and the support beam, and which is joined to the lever type pressure apparatus via a bore provided in the lever type pressure apparatus and having a diameter larger than has the bolt, so that the lever type pressure apparatus can additionally be moved pivotably on the bolt. When actuated, the lever type pressure apparatus performs a pivotal motion that has the bolt, or the rubber block that sits as well on the bolt, as a pivotal point. Simultaneous with this pivotal motion, a deformation of the rubber block will take place, the block then developing a reset force.

Another favorable design feature of the invention provides for making the elastic spring element an integral part of the lever type pressure apparatus. This allows to further simplify the design of the lever type pressure apparatus and substantially reduce the number of components required for the inventional function of the pressure apparatus.

It has proved to be positive here that the lever type pressure apparatus itself is fashioned as an elastic spring element against whose reset force the actuator acts upon its activation and which causes the pressure apparatus upon deactivation of the actuator to separate through its reset force from the doctor element. For example, the lever type pressure apparatus may be designed as a leaf spring type component or the like which assumes the functions of the elastic spring element and/or of a suitable pivotal point, or axle. Or the lever type pressure apparatus may in the area of the desired lever axle feature a local thin spot in which the actuator introduces directly or indirectly bending forces, effecting by means of the resulting bending deformation of the lever type pressure apparatus both a pivoting of the pressure apparatus for fixing the doctor element and also the intended reset force. These designs, however, only represent examples of the invention to which the invention is not limited.

According to another favorable embodiment, the actuator operating the lever type pressure apparatus is arranged on the holder side away from the mating roll and comprises one or several rod-like force transmission elements that traverse the holder and are joined with their one end, directly or indirectly, to the actuator and with their other end, directly or indirectly, to the lever type pressure apparatus. In this way, as illustrated above, not only can the applicator be disposed at a spot remote from the rather congested actuation site, but also can the region situated between the mating roll and support beam be reduced such that it is sufficient merely for accommodation and actuation of the lever type pressure apparatus. Hence, the applicator can be given a very compact design.

Especially a tubular pressure body, such as a suitably designed pressure hose, has proved itself as a actuator for actuation of the lever type pressure apparatus. Basically, however, also other pneumatic actuators or hydraulic, mechanical, electric, electromagnetic actuators and the like as well as combinations thereof can be employed.

The elastic spring element is favorably provided with a cover that protects it from the liquid or pasty medium and additionally safeguards the function of the spring element. In view of the operability of the lever type pressure apparatus, moreover, it has proved to be advantageous for the protective cover to canopy also the axle of the lever type pressure apparatus and/or the actuator, specifically when the latter is disposed in the region between the mating roll and support beam. The cover is then provided suitably on the pressure apparatus side which faces the doctor element and is exposed to greater stress by the liquid or pasty medium. Suited as a cover are specifically flexible plates, thin rubber panels or textile materials that follow an actuating motion of the lever type pressure apparatus without appreciable wear.

As to cleaning and maintenance friendliness of the inventional applicator, it has been demonstrated to be advantageous for the applicator to include at least two doctor element rests which in the length direction of the doctor element are detachably or fixedly inserted or attached in relation to the doctor element abutment with mutual clearance. The clearance between the individual rests ensures that the liquid or pasty medium cannot, as with the initially mentioned conventional applicators, accumulate and stick to the contact and support surfaces, respectively the doctor element abutment, but will due to the clearance simply drain away already in the operation of the applicator. Inaccurate fits of the contact and support faces of the doctor element resulting from dried or partly hardened liquid or pasty medium remnants can thus be avoided extensively, thereby realizing an exact seating of the fixed doctor element. This, in turn, has a positive effect on the length profile and cross profile of the applied medium that are achieved with the inventional applicator, and thus on the quality of the finished product. Cleaning of the applicator is facilitated also, and extended machine downtime caused by involved cleaning work is avoided.

Suited as support elements achieving the aforementioned advantages are specifically such with a substantially point-like contact surface for placement of the doctor element. The surface which despite the inventional support element arrangement with mutual clearance continues to be available for deposition of the liquid or pasty medium remnants, which have a negative effect on the mounting of the doctor element, is thereby minimized. Due to the relatively high point loads at these support points, any medium remnants which, as the case may be, are still present, are exposed to very high mechanical stress and, normally, removed already due to this load in the doctor element installation.

Pin-like and/or bolt-like bodies, specifically such with round cross-sectional shapes, have proved to be suitable support elements in this context. These support elements, moreover, can be fixed in their desired position by insertion in plain bores or the like.

According to a further favorable embodiment of the invention, the support element is fashioned as a sleeve type element with at least one through bore. This specific variant is suited primarily in conjunction with a cleaning apparatus, as will be illustrated hereafter.

The invention also provides for the applicator to include, furthermore, at least one rinsing and/or cleaning apparatus with which a rinsing and/or cleaning medium can be passed via at least one duct communicating with the rinsing and/or cleaning apparatus in a space bounded by the lever type pressure apparatus and/or the holder and/or the abutment and/or the doctor element. The rinsing and/or cleaning medium may be the liquid or pasty medium itself or, however, a specific cleanser. The liquid or pasty medium is suited especially for use during the machine operation, where rinsing prevents a deposition, whereas the cleanser is used preferably in a separate cleaning pass. Hence, the areas of the applicator can be protected effectively from undesirable remnants both already during operation and in a separate cleaning phase.

Lastly, a further design feature of the invention provides for the sleeve type support element to connect directly and/or indirectly to the duct communicating with the rinsing and/or cleaning apparatus, so that the rinsing and/or cleaning medium originating from the rinsing and/or cleaning apparatus can be passed through the duct and the through bore of the sleeve type support element in the space bounded by the lever type pressure apparatus and/or the holder and/or the abutment and/or the doctor element. The sleeve type support element assumes here favorably a double function, acting simultaneously both as an aid for placement of the doctor element and as a part of the rinsing and/or cleaning apparatus. Suitable as a duct for introducing the rinsing and/or cleaning medium is here, for example, a bore in which the sleeve type support element is inserted. The end of the bore associated with the cleaning apparatus may possess suitable adapters for connection to the rinsing and/or cleaning apparatus. Meant by an indirect connection of the sleeve type support element to the rinsing and/or cleaning apparatus in the sense of the invention, for example, is a connection in which further ducts or feed lines connect once again to the sleeve duct. The ducts or feed lines may also be equipped with shut-off elements. The sleeve type support element can be pushed out through the ducts receiving the sleeve type support element, by means of a pin-shaped tool, and removed again. Of course, the aforementioned adapters and shut-off elements are usable also with ducts that do not empty in the sleeve type support element.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
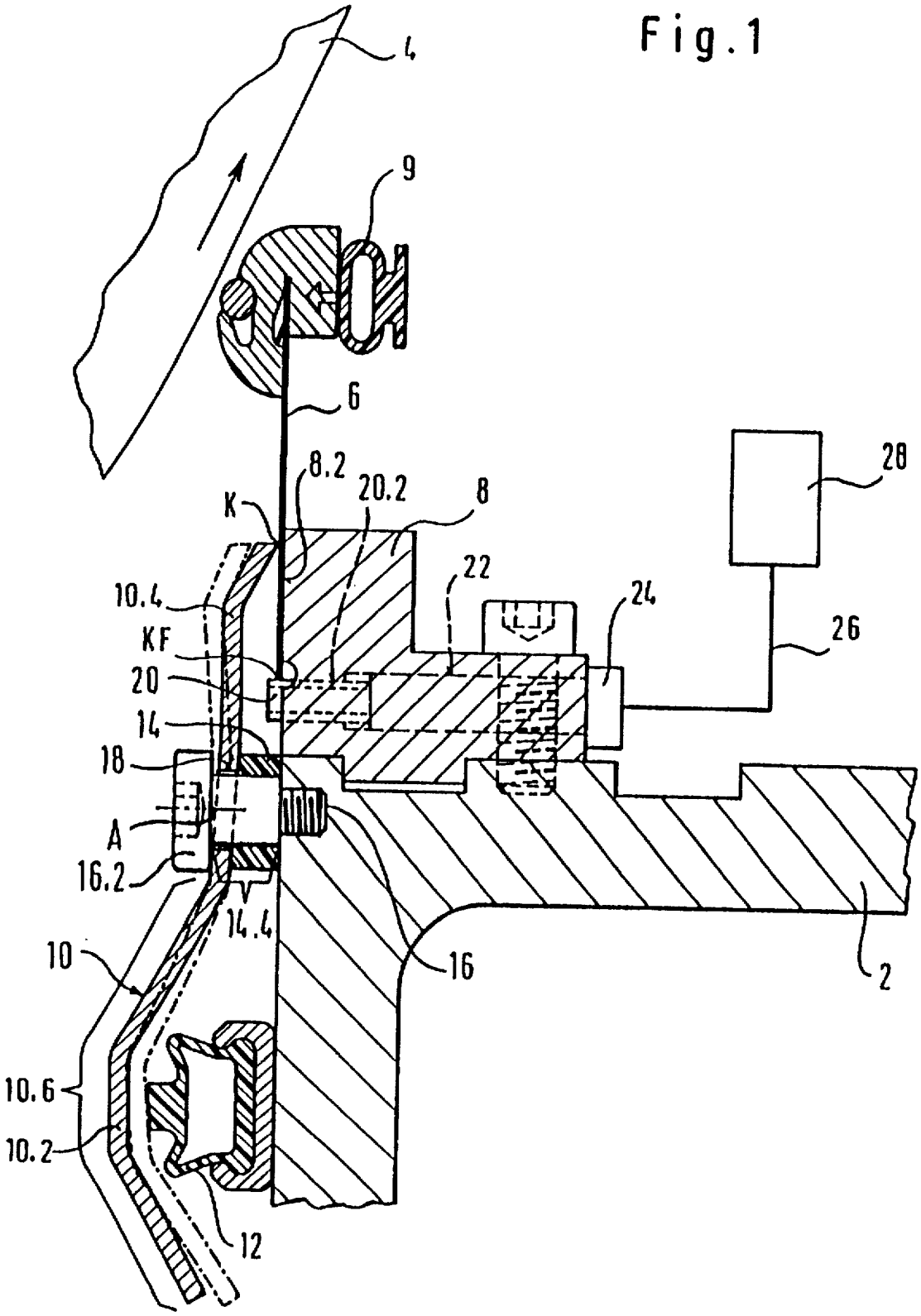
FIG. 1 is a schematic cross-sectional illustration of a first exemplary embodiment of the inventional applicator.

Corresponding reference characters indicate corresponding parts throughout the several views. The exemplifications set out herein illustrates one preferred embodiment of the invention, in one form, and such exemplifications are not to be construed as limiting the scope of the invention in any manner.

DETAILED DESCRIPTION OF THE INVENTION

FIG. 1 depicts in a schematic cross-sectional illustration a first exemplary embodiment of the inventional applicator for direct or indirect application of a liquid or pasty medium on a traveling material web, notably of paper or cardboard. The applicator includes a support beam 2 which in its length direction extends substantially across the entire width of the material web, as well as a mating roll 4 opposing the support beam 2. The mating roll 4 may be an applicator roll for producing an indirect application or a roll carrying the material web, the liquid or pasty medium being in the latter case then applied directly on the traveling material web. Extending substantially across the entire width of the mating roll 4, a doctor element 6 in the form of a roll doctor is via holder 8 fixed detachably on the side edge of the support beam 2 facing the mating roll 4. The fixing is effected via a lever type pressure apparatus 10 adapted for making contact with the doctor element 6 and disposed, when viewing the applicator sideways, i.e., in the way shown in FIG. 1, in an area between the mating roll 4 and support beam 2. This lever type pressure apparatus 10, which presently is fashioned as a double-arm lever type pressure apparatus, is referred to as a pressure lever 10 in the following description. An actuator in the form of a pressure hose 12 between pressure lever 10 and support beam 2 is in the region of the end of the double-arm pressure lever 10 away from the doctor element 6 mounted on the support beam 2 in the area situated between the mating roll 4 and support beam 2 and serves to actuate the pressure lever 10. The activation, or deactivation, of the pressure hose 12 is effected manually or by way of a suitable control. Pressure-generating apparatuses known as such are provided for operation of the pressure hose 12.

Additionally, the applicator is equipped with a usual pressure element 9 mounted on the support beam and acted upon with a pressure force, directly or indirectly, by a pressure apparatus. Pressure element 9 serves to press the doctor element 6, in the area of its end coordinated with the mating roll 4, on the mating roll 4 for adjustment and/or regulation of the pressure, of the coating angle as well as the cross profile and length profile.

As can be seen in FIG. 1, moreover, the lever arm 10.2 of the double-arm pressure lever 10 associated with the pressure hose 12 includes a section 10.6 which in the fashion of an arc angles toward the mating roll 4. Pressure hose 12 protrudes partly into this section. The area situated between the mating roll 4 and support beam 2 and tapering toward the doctor element 6 is thereby spatially utilized optimally.

Furthermore, the inventional applicator includes an elastic spring element 14 that acts directly on the pressure lever 10 and against the reset force of which the pressure hose 12 acts upon its activation, and which upon deactivation of the pressure hose 12 separates the pressure lever 10 from its contact K with the doctor element 6, due to the reset force, and releases the doctor element 6 for removal from its holder. Made in the present case of an elastomeric material, the elastic spring element 14 is in the immediate area of the axle A of the pressure lever 10 arranged between the pressure lever 10 and a support surface 8.2 near the support beam and acting as abutment, of the doctor element holder 8, and forms together with a threaded bolt 16 traversing the pressure lever 10 and elastic spring element 14 simultaneously the axle A of the pressure lever 10. The threaded bolt 16 possesses a cylindrical section bordering on the bolt head 16.2, acting as a spacer 16.4 and presetting a fixed clearance between the support-beam-proximal support surface 8.2 and the underside of the bolt head 16.2. To allow the threaded bolt 16 to traverse the pressure lever 10 in the area of lever axle A, the pressure lever 10 is provided with a bore 18 which has a diameter slightly larger than that of the spacer 16.4 of bolt 16, allowing the pressure lever 10 to pivot on the bolt 16. Fashioned as sleeve type rubber block, the elastic spring element 14 is as well placed, in the previously described arrangement, on the spacer 16.4 of bolt 16 and thus fixed without clearance between the pressure lever 10 and the support-beam-proximal support surface 8.2. The elastic spring element 14 is in direct contact with the pressure lever 10. When now actuating the pressure hose 12 starting from a neutral position of pressure lever 10 as indicated in the drawing by dashed line, the pressure lever 10 pivots about axle A and deforms the elastic spring element 14, against the reset force of which acts the pressure hose 12. The activated pressure hose 12 moves the pressure lever 10 to the lever position illustrated in FIG. 1 by a solid line, in which the top end of the lever arm 10.4 of the double-arm pressure lever 10 associated with the doctor blade 6 makes contact K with the doctor element 6, pressing it firmly on an abutment formed by a support surface 8.2 of the holder 8, thus fixing it positionally. In deactivating the pressure hose 12, the elastic spring element 14 automatically negates the contact K with the doctor element 6, due to its reset force acting on the pressure lever 10, thereby opening the holder of doctor element 6, releasing the latter. The pressure lever 10 restores then to its neutral position illustrated by dashed line.

As illustrated in FIG. 1, the doctor element 6 is with its narrow side edge away from the mating roll 4 placed on two or more support elements 20 which in the length direction of doctor element 6 are mutually spaced and inserted detachably or fixedly in abutting support surface 8.2, that is, in the side surface 8.2 of the holder 8, and protrude slightly out of the side surface. The support elements 20, which presently are fashioned as mounting sleeves 20 inserted in bores 22, possess a substantially point-like contact surface KF on which to rest the doctor element 6. The bores 22 receiving the mounting sleeves 20 continue toward the side of the holder 8 away from the mating roll 4 and form together with the through bore 20.2 of the mounting sleeve 20 a duct 22 which via a suitable adapter 24 and feed lines 26 connects to a rinsing and/or cleaning apparatus 28. A rinsing and/or cleaning medium originating from the rinsing and/or cleaning apparatus 28 can in this way be passed through the duct 22 and the through bore 20.2 of mounting sleeve 20, into the space bounded by the pressure lever 10 and doctor element 6, respectively its abutment or support surface 8.2. The rinsing and/or cleaning medium may be the liquid or pasty medium itself or a specific cleaning agent. When using the liquid or pasty medium as rinsing and/or cleaning medium, the option presents itself to incorporate the rinsing and/or cleaning apparatus 28 in a circulation circuit so as to minimize the consumption of liquid or pasty medium and keep the pump outputs required for circulation low. In addition to the pump apparatuses, the circuit may also include shut-off devices, filter and valve apparatuses and the like. A circuit of that type is not shown in the drawings for the sake of clarity. The rinsing and/or cleaning medium can be used both during operation of the applicator and also in a separate cleaning pass and prevents undesirable depositions and remnants of the liquid or pasty medium on the doctor element holder 8, 20 and pressure lever 10. Also the duct 22 and feed lines 26 provided for connection to the rinsing and/or cleaning apparatus 28 may be equipped with shut-off elements, valves and the like.

Figure 2:
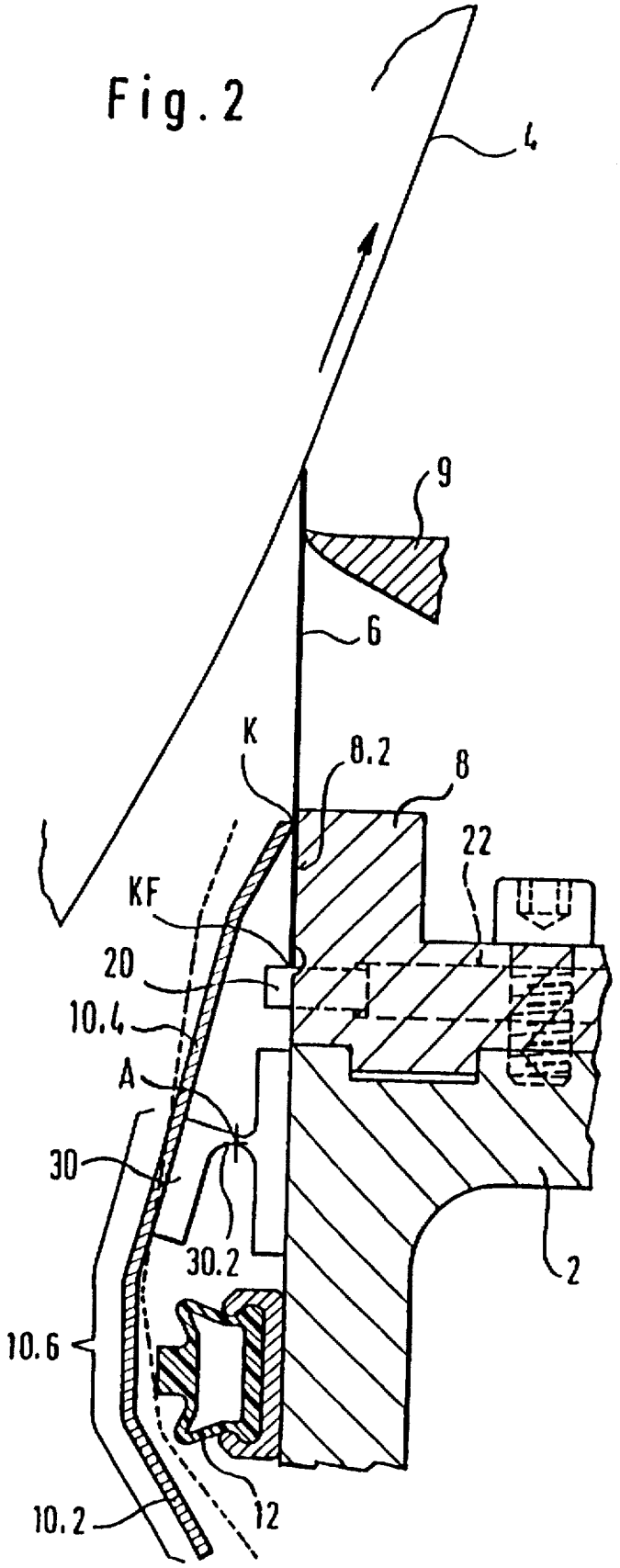
FIG. 2 is a schematic cross-sectional illustration of a second exemplary embodiment of the inventional applicator.

FIG. 2 shows a schematic cross-sectional illustration of a second exemplary embodiment of the inventional applicator. This variant corresponds in its basic structure substantially to that relative to FIG. 1. Instead of a roll doctor, a doctor blade is used here as doctor element 6. This applicator includes as well a double-arm pressure lever 10 which via a component 30 with the cross-sectional shape of a mirror-inverted "h" connects jointedly to the support beam 2. Presently made of a suitable plastic or metallic material, the h-shaped component 30 assumes both the function of a joint for the axle A of pressure lever 10 and the function of the elastic spring element (refer to reference 14 in FIG. 1). As illustrated in the drawing, the h-shaped component 30 possesses a local, reduced spot 30.2 in which the actuator, that is, the pressure hose 12, introduces upon its activation a bending force, deforming the h-shaped component 30 in the area of the thin spot 30.2 to the effect that the thin spot 30.2 acts as axle A for the pressure lever 10. Due to the bending deformation of the h-shaped component 30 resulting from the force effect of pressure hose 12, however, not only a pivoting of the pressure lever 10 for fixing the doctor element 6 is occasioned, but also a reset force is generated against which acts the pressure hose 12 upon its activation and which upon deactivation of the pressure hose 12 eliminates the contact K between the pressure lever 10 and doctor element 6, releasing the latter. The neutral position of pressure lever 10 is indicated in FIG. 2 by dashed line. Used as support elements 20 for the doctor element 6, in the embodiment according to FIG. 2, are plain pin type or screw type bodies that are inserted in an appropriate bore 22 in the side surface 8.2, of the doctor element holder 8, that forms the abutment 8.2 of the doctor element 6.

Figure 3:
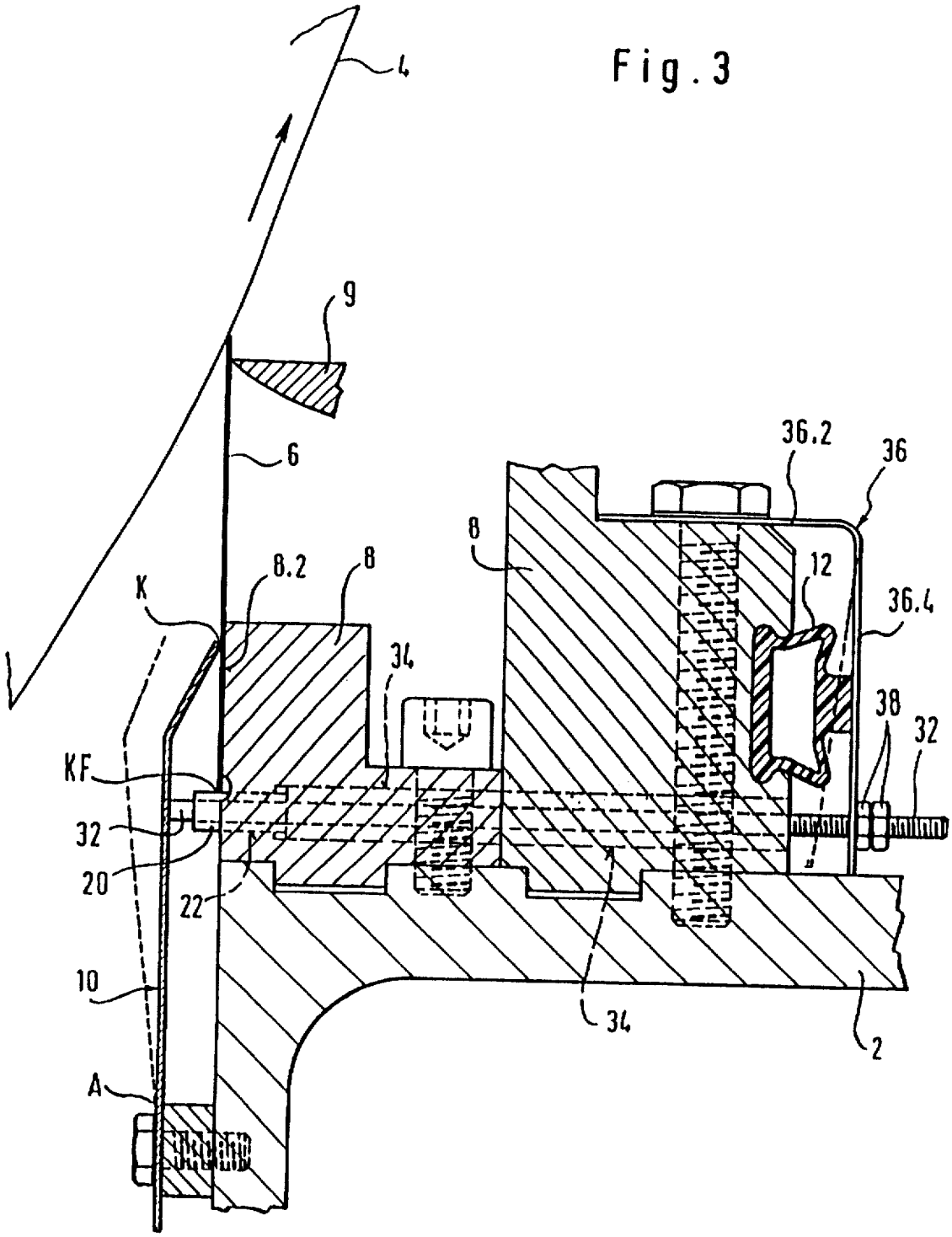
FIG. 3 is a schematic cross-sectional illustration of a third exemplary embodiment of the inventional applicator.

FIG. 3 shows in a schematic cross-sectional illustration a third exemplary embodiment of the inventional applicator. Corresponding in its basic structure substantially to that in FIGS. 1 and 2, this embodiment includes as an elastic spring element a single-arm pressure lever 10 fashioned as a leaf spring. Contrary to FIGS. 1 and 2 where separate elastic spring elements 14, 30 are used, pressure lever 10 in FIG. 3 includes the elastic spring element as an integral part. Once activated, the pressure hose 12 acts against the reset force of pressure lever 10, while at deactivation of pressure hose 12 the reset force of pressure lever 10 lifts the contact K with the doctor blade 6, releasing the latter. The neutral position, where no contact exists between doctor blade 6 and pressure lever 10, is indicated by dashed line in FIG. 3.

A further feature of the embodiment relative to FIG. 3 consists in arranging the pressure hose 12 that actuates the doctor blade press apparatus on the side of the doctor element holder 8 away from the mating roll 4 and having it include one or several rod-like force transmission elements 32 which via through bores 34 provided in the holder 8 traverse the holder 8 and connect with their one end directly to the pressure lever 10 and with their other end communicate indirectly with pressure hose 12. The indirect connection of the rod-like force transmission elements 32 to the pressure hose 12 is presently effected via a bow 36 having substantially the cross-sectional shape of an "L" and being fixed with one shank 36.2 to an area of the doctor element holder 8 away from the mating roll 4. Extending approximately vertically in the illustration relative to FIG. 3, the second shank 36.4 of bow 36, to which attaches also the end of the rod-like force transmission element 32 away from the mating roll 4, bears on the pressure hose 12 once it is activated, and thus transmits the actuating force by means of the rod-like force transmission element 32 to the single-arm pressure lever 10. Upon deactivation of the pressure hose, the bow 36 and pressure lever 10 restore due to the reset force of pressure lever 10 to the neutral position indicated in FIG. 3 by dashed line.

When using sleeve type support elements 20, as in FIG. 1, a single rod-like force transmission element 32 can protrude also through the bore 22 for the support element 20 and its through bore 20.2.

Instead of the single-arm pressure lever 10, moreover, the above bow 36 may be fashioned as elastic spring element against the reset force of which acts the pressure hose 12 upon its activation and which, due to its reset force, lifts in the deactivation of pressure hose 12 via the rod-like force transmission elements 32 the contact K between pressure lever 10 and doctor element 6, releasing the latter. Such variant would thus represent an elastic spring element acting indirectly on the lever type press apparatus of the doctor element. As indicated in FIG. 3, furthermore, the ends of the rod-like force transmission elements 32 away from the mating roll 4 are provided with a suitable manual or automatic adjustment apparatus 38 that allows adjustment of both the position of the single-arm pressure lever 10, respectively bow 36, and the prestress of these components.

Figure 4:
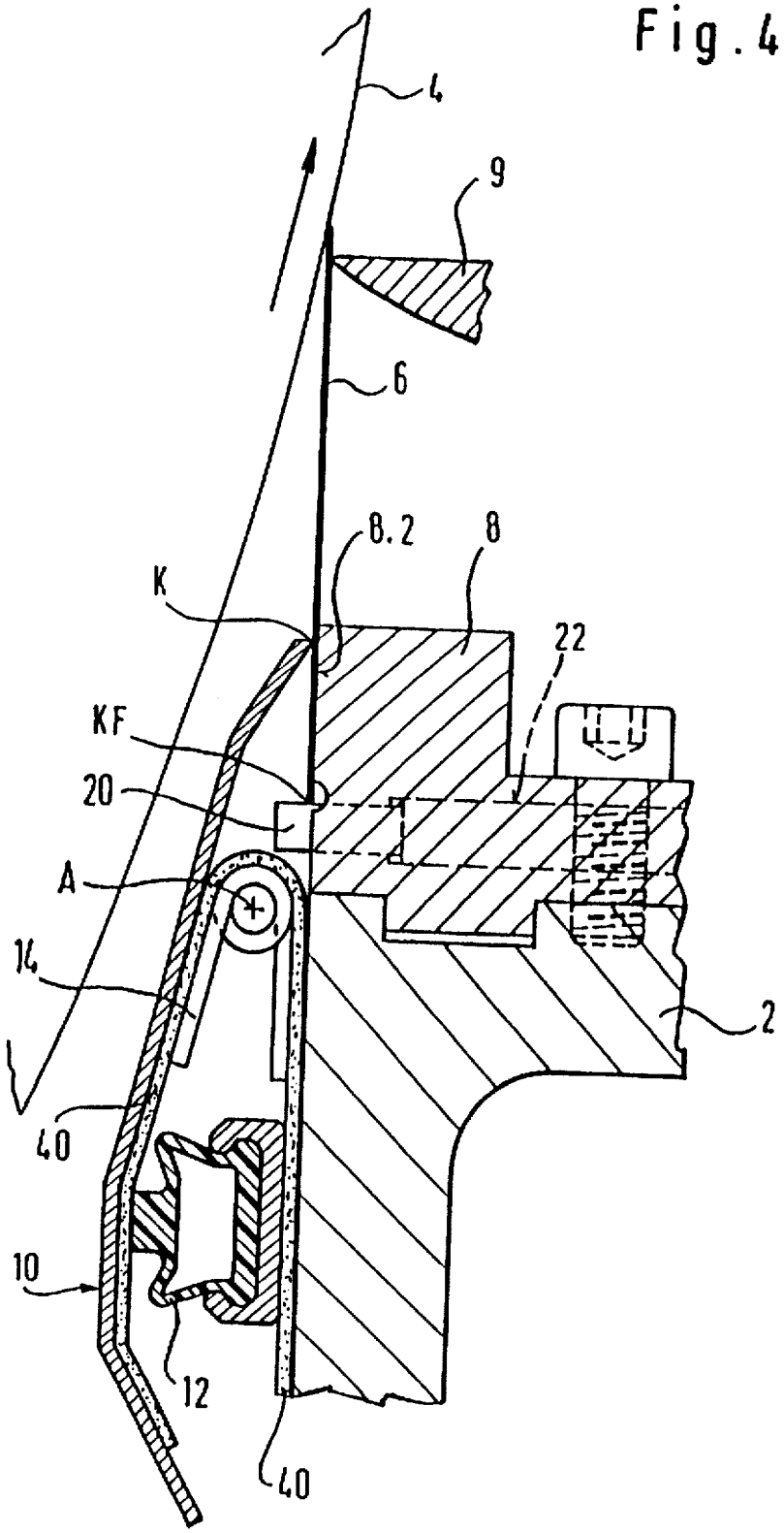
FIG. 4 is a schematic cross-sectional illustration of a fourth exemplary embodiment of the inventional applicator.

FIG. 4 shows a schematic cross-sectional illustration of a fourth exemplary embodiment of the inventional applicator. The basic structure of this variant corresponds substantially to those in FIG. 1 and 2. Contrary thereto, however, the applicator includes a protective cover 40 that canopies both the axle A of pressure lever 10 and also the spring element 14 and pressure hose 12. Fashioned as a thin rubber panel 40 or the like, the protective cover extends on the side facing the doctor blade 6 and stressed more so by the liquid or pasty medium beyond the lever axle area, protecting it and the pressure hose 12 disposed beneath from the effect of the liquid or pasty medium. The jointed junction of pressure lever 10 to the support beam 2 is presently effected by way of simple hinges, of which in the illustration relative to FIG. 4 only the parts forming the axle A of pressure lever 10 are visible.

The invention is not limited to the above embodiments, which represent merely general examples. Instead, the inventional applicator may within the scope of protection assume embodiments other than those illustrated above. For example, suitable actuators other than the pressure hose may be used as actuators. Moreover, the shape of the pressure lever and the design of the doctor blade pressure apparatus as well as the doctor blade holder may vary from the variants described above. Instead of the elastic spring elements used in the framework of the exemplary embodiments, also other suitable spring elements may basically be employed, for example, tension springs, torsion springs, saucer springs of metal or other materials as well as specifically rubber springs, respectively springs of thermoplastics, duroplastics and elastomers and the like. The spring element may or may not be prestressed in its neutral position in which it does not develop a reset force, and adjustment devices may as well be provided that preset a specific position or tension of the elastic spring element relative to the lever type pressure apparatus. In the case of using rod-like force transmission elements transmitting a force from the actuator to the lever type pressure apparatus, these may, depending on the design of the support beam and the doctor blade holder, also traverse the support beam or extend beyond the holder. Moreover, it is not mandatory that in conjunction with the rinsing and/or cleaning apparatus the rinsing and/or cleaning medium supply take place via the through hole of the mounting sleeve. Similarly, separate feed ducts and/or outlet openings are conceivable.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An applicator for one of direct and indirect application of a coating medium onto a traveling fiber material web having a width, said applicator comprising:

a support beam having a length which extends substantially across the width of the fiber material web;

a mating roll positioned in association with said support beam and having a length which extends substantially across the width of the fiber material web;

a doctor element extending substantially across the width of the mating roll, said doctor element having one end associated with said mating roll and an opposite end;

a holder connected with said support beam and detachably connected with said opposite end of said doctor element, said holder including an abutment surface;

a pressure element carried by said support beam, said pressure element being configured to force said one end of said doctor element toward said mating roll;

a lever pressure apparatus configured to contact said doctor element, said pressure apparatus disposed between said mating roll and said support beam when said applicator is viewed in cross section;

an activatable actuator engaging said pressure apparatus and coacting with said pressure apparatus when activated to press said doctor element against said abutment surface; and at least one elastic spring element associated with and exerting a reset force against said pressure apparatus, said reset force acting against said actuator upon activation of said actuator, said reset force disengaging said contact between said pressure apparatus and said doctor element upon deactivation of said actuator.

2. The applicator of claim 1, wherein said lever type pressure apparatus comprises a single-arm lever pressure apparatus.

3. The applicator of claim 1, wherein said lever type pressure apparatus comprises a double-arm lever pressure apparatus.

4. The applicator of claim 3, wherein said pressure apparatus includes a lever arm having one end which contacts said doctor element and a distal end opposite said one end, said actuator engaging said distal end of said lever arm.

5. The applicator of claim 4, wherein said lever arm includes at least one section which is angled toward said mating roll.

6. The applicator of claim 1, wherein said pressure apparatus includes an axle (A), and wherein said elastic spring element is disposed in an immediate area of said axle (A) between said pressure apparatus and said abutment surface.

7. The applicator of claim 6, wherein said elastic spring element defines said axle (A) of said pressure apparatus.

8. The applicator of claim 7, further comprising a spacer connected with at least one of said support beam and said holder, said pressure apparatus being pivotally mounted one said spacer.

9. The applicator of claim 1, wherein said pressure apparatus integrally includes said elastic spring element.

10. The applicator of claim 9, wherein said pressure apparatus and said elastic spring element are of monolithic construction.

11. The applicator of claim 1, wherein said actuator is disposed on a side of said holder away from said mating roll, and further comprising a plurality of rod force transmission elements traversing said holder, each said rod force transmission element being connected at one end thereof with said actuator and at an opposing end thereof with said pressure apparatus.

12. The applicator of claim 1, wherein said actuator is a hose pressure body.

13. The applicator of claim 1, further comprising a protective cover over said elastic spring element.

14. The applicator of claim 13, wherein said pressure apparatus includes an axle (A), and wherein said protective cover further covers at least one of said axle (A) and said actuator.

15. The applicator of claim 1, further comprising at least one support element attached to said abutment surface and supporting said doctor element.

16. The applicator of claim 15, further comprising at least one individual support element carried by said support beam, each said support element having a substantially point contact surface (KF) for supporting said doctor element.

17. The applicator of claim 16, wherein said support element comprises at least one of a pin body and bolt body.

18. The applicator of claim 16, wherein each said support element comprises a sleeve type support element with at least one through opening.

19. The applicator of claim 18, wherein at least one of said support beam and said holder includes at least one duct terminating at said abutment surface, and further comprising a cleaning apparatus disposed in fluid communication with each said duct, said cleaning apparatus configured to pass a cleaning medium through said duct and into a space bounded by at least one of said pressure apparatus, said abutment surface and said doctor element.

20. The applicator of claim 19, wherein each said sleeve support element is coupled with a respective said duct, and wherein said cleaning apparatus is in fluid communication with each said duct and each said through opening, said cleaning apparatus configured to pass the cleaning medium through each said duct and each said through opening and into said space bounded by at least one of said pressure apparatus, said abutment surface and said doctor element.

* * * * *